US005367501A

United States Patent [19]

Kelly et al.

[11] Patent Number: 5,367,501

[45] Date of Patent: Nov. 22, 1994

[54] DUAL-FREQUENCY SONAR SYSTEM

[75] Inventors: James G. Kelly, Newport; Charles R. Walsh, Tiverton, both of R.I.

[73] Assignee: The United States of America as represented by the Secretary of the Navy, Washington, D.C.

[21] Appl. No.: 1,978

[22] Filed: Jan. 8, 1993

[51] Int. Cl.[5] ..... H04R 17/00

[52] U.S. Cl. ..... 367/157; 367/158; 310/800; 310/337; 114/21.2

[58] Field of Search ..... 367/157, 158; 310/800, 310/337; 114/21.2

[56] References Cited

U.S. PATENT DOCUMENTS

| | | | |
|---|---|---|---|
| 4,192,246 | 3/1980 | Hodges et al. | 114/23 |
| 4,373,143 | 2/1983 | Lindberg | 310/334 |
| 4,633,119 | 12/1986 | Thompson | 310/325 |
| 4,737,939 | 4/1988 | Ricketts | 367/158 |
| 4,811,307 | 3/1989 | Pohlenz et al. | 367/135 |
| 4,950,936 | 7/1990 | Rynne et al. | 310/337 |

*Primary Examiner*—J. Woodrow Eldred

*Attorney, Agent, or Firm*—Michael J. McGowan; Prithvi C. Lall; Michael F. Oglo

[57] ABSTRACT

A dual frequency, polymer hydrophone, array for a submersible vehicle is disclosed. A mid-frequency transducer array is employed in the forward end of a submersible vehicle. Between the mid-frequency array and a nose portion of the submersible vehicle is a single or multiple board piezoelectric polymer array employed to implement a secondary, high-frequency transducer array. Amplifying and signal conditioning units are mounted adjacent or on one metallic electrode layer or formed integrally thereon to minimize signal lead loss. The piezoelectric polymer material is chosen to have a density coefficient and sound velocity substantially equivalent to an acoustic window in the nose portion of the submersible vehicle and to be substantially transparent to the mid-frequency array. Minimal degradation of the mid-frequency received or transmitted signals occurs due to the transparency of the high-frequency array. Benefits of the present invention include providing wide area search capability with the mid-frequency array and high-resolution homing and object classification, among other things, with the high-frequency transducer array.

15 Claims, 3 Drawing Sheets

DUAL-FREQUENCY SONAR SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention is directed to the field of electroacoustics and more particularly, to a novel dual-frequency sonar system.

(2) Description of the Prior Art

Several patents teach the use of piezoelectric transducers for transmitting or receiving specific frequency bands in underwater applications. One of the earliest is King, U.S. Pat. No. 2,409,632, which employs two forward facing arrays of piezoelectric crystals arranged along either side of a torpedo's forward axis. Each array is comprised of transducers which radiate at and are responsive to a separate frequency band. By turning the torpedo until the received echoes at both frequency bands are roughly equal, the torpedo is able to track and home in on a reflecting target. A drawback of this approach is that the direction of a target may only be determined as left, right or directly ahead. It is necessary that a target be measured with a higher degree of angular resolution. This can be achieved only when numerous beams can be formed.

Hodges et al., U.S. Pat. No. 4,192,246, discloses a torpedo nose design intended to minimize flow noise from sources such as cavitation. The invention includes the use of Tonpilz-type transducers glued to an acoustic window which forms the nose of the torpedo, but enables transmission and reception only at one frequency band.

The use of a composite layered assembly in piezoelectric polymer arrays in hydrophones is disclosed in Francis, U.S. Pat. No. 4,638,468. It teaches the use of a layered assembly of piezoelectric polymer and printed-circuit board material for hydrophone elements and the connection of associated amplifiers. This invention describes a method of constructing piezoelectric polymer transducers, and does not describe a specific application beyond their use in hydrophone arrays. It does not address the possibility of using multiple arrays to operate at more than one frequency band, the same drawback found in Hodges et al.

Hoering, U.S. Pat. No. 4,916,675, proposes a method of using unique transducer rings to form a device which can radiate and receive more than one range of frequencies. This approach, however, provides radiation and reception of a full three hundred-sixty degrees. The ability to form numerous beams for the determination of angular offset is missing.

A simple, low cost and easily fabricated arrangement of piezoelectric transducers with maximized response characteristics in more than one frequency band along the axis of an underwater vehicle is lacking, and much needed, to provide effective and timely detection and identification of underwater objects.

SUMMARY OF THE INVENTION

In accordance with the present invention, a dual-frequency polymer hydrophone array for a submersible vehicle is disclosed. Benefits of the present invention include providing high resolution object classification and interference rejection. A lower-frequency transducer array similar to that described in Hodges et al., U.S. Pat. No. 4,192,246, is employed in the forward end of a submersible vehicle. Between the lower-frequency array and a nose portion of the submersible vehicle, piezoelectric polymer array is employed to implement a secondary, higher-frequency transducer array. The polymer material is chosen to have a density coefficient, $\rho$, and sound velocity, c, substantially equivalent to the nose portion making up the end of the submersible vehicle, normally polyurethane or neoprene, which are both matched to the characteristic acoustic impedance of the marine environment, typically seawater, making the higher-frequency array and the nose acoustically transparent to the lower-frequency array. One such material is polyvinylidene fluoride (PVDF). Minimal degradation of the lower-frequency received or transmitted signals occurs due to the transparency of the higher-frequency array.

The PVDF hydrophone is comprised of a thickness of PVDF material covered on both sides with electrode (metallic) material. The high-frequency array is comprised of narrow elements formed by etching through the metallic layer forming one of the electrodes of the piezoelectric polymer hydrophone. The elements need to be formed on only one side of the hydrophone and the electrode on the other side may be used as a common or ground point. The groups of elements thus formed may be formed into a single board constituting an array or into a multiplicity of boards each of which will constitute a sub-array.

Due to the small capacitance of the polymer hydrophone elements, amplifying and signal conditioning units are mounted adjacent or on one metallic layer or formed integrally thereon to minimize signal lead loss. In one embodiment to minimize the amount of material between the lower-frequency array and the nose of the vehicle, the higher-frequency array only receives reflected sonic radiation. Conventional higher-frequency ceramic radiating transducers are arranged substantially coplanar to, and around the periphery of, the higher-frequency receiving array.

The benefits of the present invention referred to above are possible because it provides arrays responsive to two frequencies. The lower-frequency array is useful in that it provides a long-range and a wide beam pattern for searching greater areas. This array has a surface area as large as the submersible vehicle nose will allow thereby maximizing this array's capabilities.

The secondary, higher-frequency piezoelectric polymer array is mounted directly in front of the lower-frequency array and is responsive to reflected signals in a narrower beam pattern, and at correspondingly higher angular resolution than the lower-frequency array. In underwater environments higher frequencies suffer higher attenuation. The two arrays compliment each other; the lower-frequency array covers a larger search area with lower resolution, and the higher-frequency array provides more detailed information on a reflecting object at closer range and within a smaller area.

A further benefit is the lower cost involved in using a piezoelectric polymer in contrast to a comparable ceramic material.

BRIEF DESCRIPTION OF THE DRAWINGS

Other features, objects and benefits of the invention can be more clearly understood with reference to the following description of an illustrative embodiment, and to the drawings, in which.

DESCRIPTION OF THE PREFERRED EMBODIMENT

Figure 1:
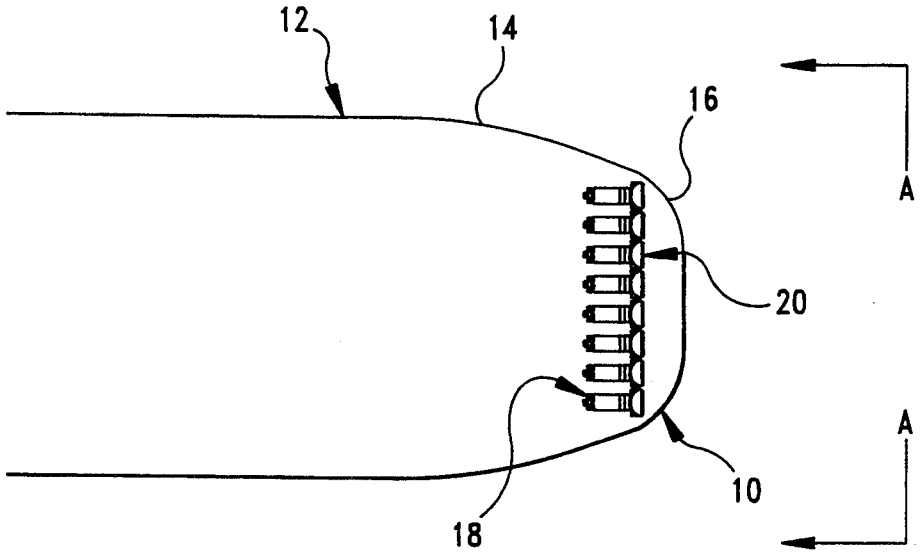
FIG. 1 is a sectioned, partial side elevation view of a dual-frequency polymer hydrophone array mounted in a nose portion of an underwater vehicle.
Figure 2:
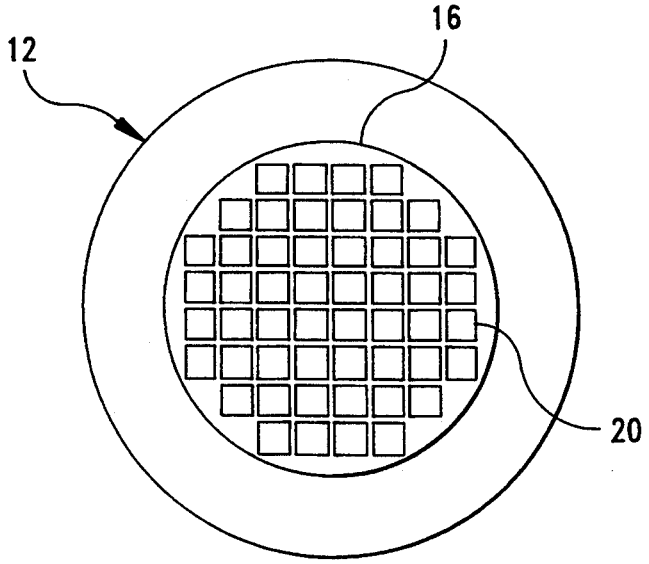
FIG. 2 is a front elevation view of the dual frequency, polymer hydrophone, array and vehicle taken along line A—A of FIG. 1.

Referring now to FIG. 1, a dual frequency, polymer hydrophone, array 10 is shown mounted in a nose portion 14 of an underwater vehicle 12. The dual frequency, polymer hydrophone, array 10 is comprised of two individual arrays, a higher-frequency piezoelectric polymer hydrophone array 20, operating in a range, typically 5 to 10 times the frequency of a lower-frequency array 18. The actual frequencies of operation are determined by the application requirements, and limited only by available space and fabrication techniques. Both arrays 18 and 20 are located proximally to an acoustic window 16 in the nose portion 14. FIG. 2 illustrates the arrangement of the higher-frequency array 20 behind the nose portion 16 of the vehicle 12. The array 20 may be provided having square, rectangular or circular shaped elements.

Figure 3:
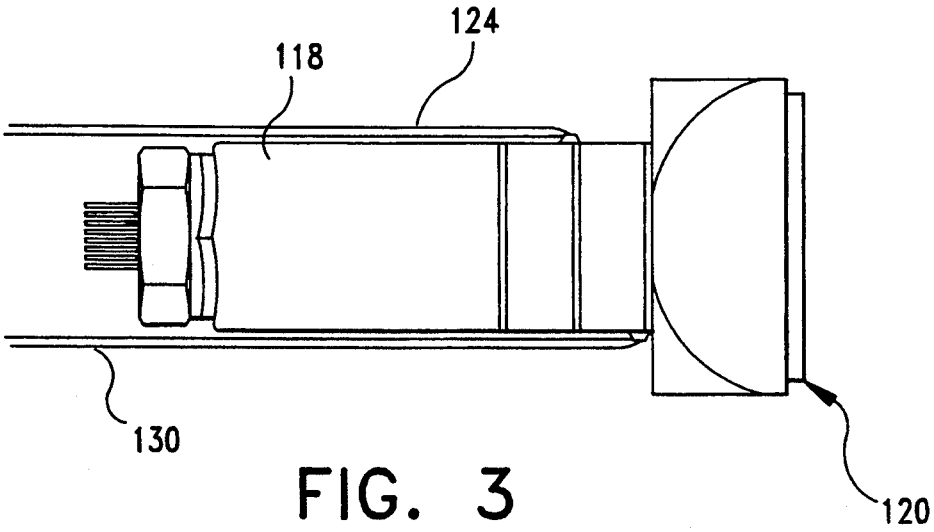
FIG. 3 is side elevation view of a lower-frequency transducer and a higher-frequency hydrophone mounted thereon.

In FIG. 3, one element 118 of the lower-frequency array 18 is shown with a subarray 120 of the higher-frequency array 20 attached thereto. Lower-frequency array conductors 124 and higher-frequency subarray conductors 130 run along the length of the lower-frequency element 118. The lower-frequency element 118 can be of the Tonpilz variety of ceramic polymer transducer, but may be a ceramic disc, cylinder or other type of element.

Figure 4:
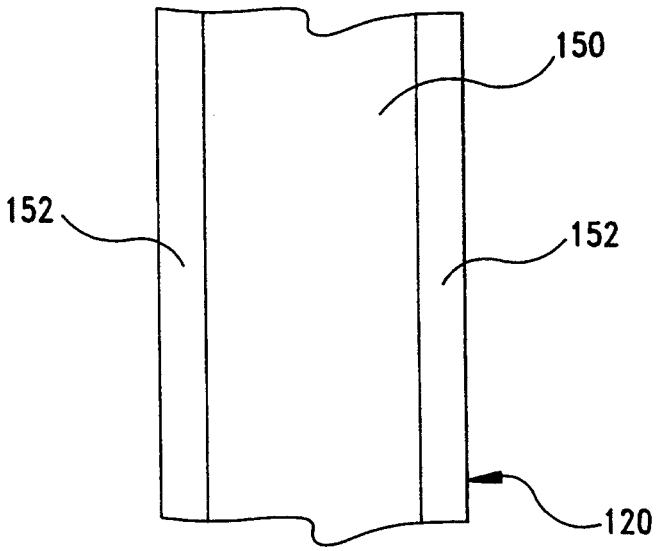
FIG. 4 is a partial side elevation view of the higher-frequency hydrophone.

Referring to FIG. 4, a representative cross-section of a higher frequency subarray 120 illustrates two metallic conducting layers 152 attached to a central piezoelectric polymer inner core 150. In one embodiment, the polymer core 150 is made of polyvinylidene fluoride (PVDF), which can be made to have a density coefficient and speed of sound roughly equivalent to the acoustic window 16 material, typically polyurethane or neoprene, and the seawater in which the torpedo 12 travels.

Figure 5:
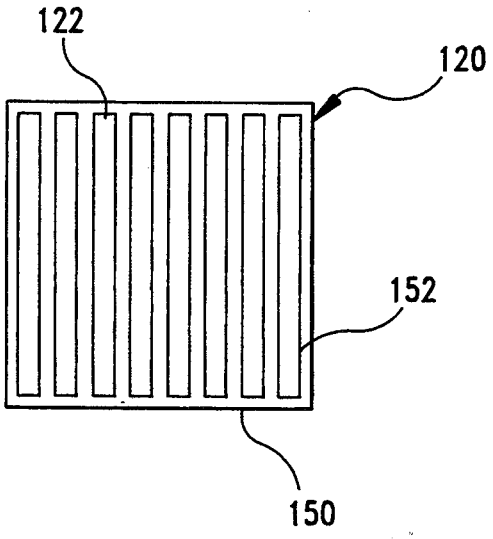
FIG. 5 is a front elevation view of the higher-frequency hydrophone of FIG. 3.

FIG. 5 presents a front view of the higher-frequency subarray 120, showing a multiplicity of receiving elements 122 left over after having etched away the metallic conducting layer 152 in the interelemental interstices. Since the subarray 120 is intended to be sensitive to relatively higher-frequencies, the receiving elements 122 are relatively narrow, so as to allow a spacing of, typically $\lambda/2$, where $\lambda$ is equal to the wavelength of the signal in water. In combination with a polymer inner core 150 of appropriate density coefficient, selected to be transparent, the higher-frequency subarray 120 causes minimal attenuation of mid-frequency radiation.

Figure 6:
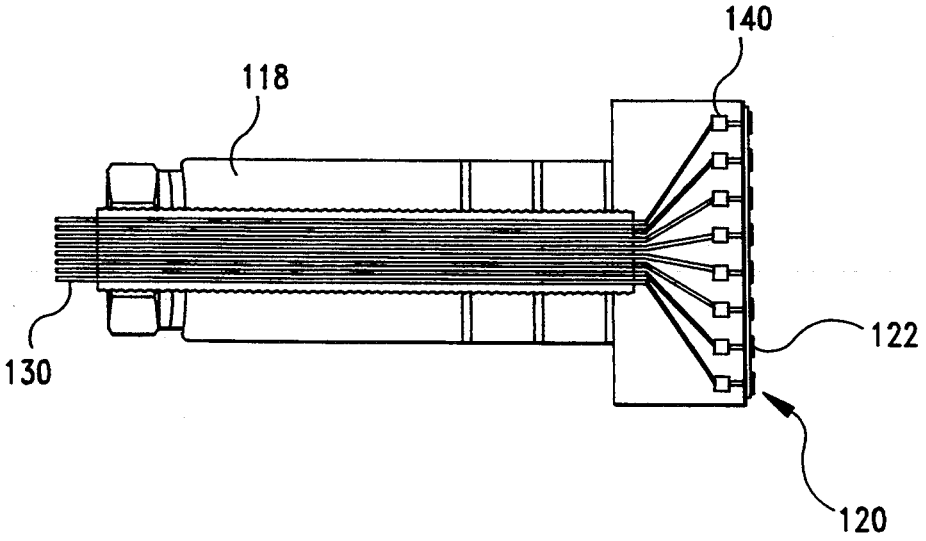
FIG. 6 is a bottom plan view of the lower-frequency transducer and higher-frequency hydrophone mounted thereon of FIG. 3.

FIG. 6 presents the lower-frequency element 118 and higher-frequency subarray 120 of FIG. 3 from below. Due to the relatively low capacitance of the polymer hydrophone array elements 122, a multiplicity of amplifying and/or signal conditioning units 140 are mounted either behind the subarray 120, or built into the metallic conducting layer 152. In this embodiment, there is one amplifying and signal conditioning unit 140 for each higher-frequency subarray element 122. The higher-frequency subarray conductors 130 are shown running along a bottom side of the lower-frequency element 118.

These and other examples of the invention illustrated above are intended by way of example and the actual scope of the invention is to be determined from the following claims. For example, the underwater vehicle depicted in FIG. 1 may correspond to a torpedo, a remotely operated vehicles (ROV), an unmanned underwater vehicles (UUV) or any other like devices. Furthermore, the invention may be used as a passive sonar (listening only) as well as an active sonar.

What is claimed is:

1. A dual frequency sonar apparatus for marine vessels operating in an aqueous environment, comprising:
   a lower-frequency transducer array; and
   a higher-frequency hydrophone array, disposed in front of said lower-frequency transducer array, each of said arrays confronting the aqueous environment, said higher-frequency array being fabricated of a piezoelectric polymer material that is substantially transparent to the lower-frequency transducer array.

2. The dual-frequency apparatus claim 1, wherein the dual-frequency array is disposed in a first one of:
   a nose of a torpedo;
   an unmanned undersea vehicle; or
   a stationary platform.

3. The dual-frequency apparatus of claim 1, wherein the higher-frequency hydrophone array is comprised of a multiplicity of piezoelectric polymer based elements and a multiplicity of signal conditioning amplifiers.

4. The dual-frequency apparatus of claim 3, wherein the piezoelectric polymer material has a density coefficient and a sound velocity transmissivity roughly equivalent to the aqueous environment.

5. The dual-frequency apparatus of claim 3, wherein the higher frequency hydrophone array is physically mounted on the lower-frequency transducer array.

6. The dual-frequency apparatus of claim 1, wherein the higher-frequency hydrophone array is comprised of a sheet of piezoelectric polymer material between two metallic electrode layers.

7. The dual-frequency apparatus of claim 1, wherein the higher-frequency hydrophone array is comprised of a multiplicity of coplanar subarrays.

8. The dual-frequency apparatus of claim 7, wherein said subarrays are comprised of a multiplicity of piezoelectric polymer based elements.

9. The dual-frequency apparatus of claim 3, wherein the multiplicity of piezoelectric polymer based elements are formed by etching into one of the two metallic electrode layers.

10. The dual-frequency apparatus of claim 3, wherein the piezoelectric polymer based elements have a center frequency of approximately seventy-five (75) kilohertz to one-hundred-fifty (150) kilohertz.

11. The dual-frequency apparatus of claim 3, wherein the multiplicity of signal conditioning amplifiers are mounted on one of the metallic electrode layers.

12. The dual-frequency apparatus of claim 3, wherein the multiplicity of signal conditioning amplifiers are built directly into one of the metallic electrode layers.

13. The dual-frequency apparatus of claim 1, wherein the piezoelectric polymer material is piezoelectric polyvinylidene fluoride (PVDF).

14. The dual-frequency apparatus of claim 1, wherein the lower-frequency transducer array is comprised of a multiplicity of elements of a Tonpilz variety.

15. The dual-frequency apparatus of claim 1, wherein the lower-frequency transducer array is comprised of a multiplicity of elements of piezoelectric ceramic material.

* * * * *